United States Patent [19]

Hoelzl

[11] Patent Number: 4,598,933

[45] Date of Patent: Jul. 8, 1986

[54] ANTI-THEFT LOCK FOR SKIS

[75] Inventor: Klaus Hoelzl, Vienna, Austria

[73] Assignee: TMC Corporation, Baar, Switzerland

[21] Appl. No.: 661,767

[22] Filed: Oct. 17, 1984

[30] Foreign Application Priority Data

Oct. 21, 1983 [AT] Austria ..... 3756/83

[51] Int. Cl.[4] ..... A63C 11/02

[52] U.S. Cl. ..... 280/809; 70/58; 70/DIG. 57; 280/618

[58] Field of Search ..... 70/57, 58, DIG. 57; 280/809, 814, 617, 618

[56] References Cited

U.S. PATENT DOCUMENTS

| | | | |
|---|---|---|---|
| 2,482,341 | 9/1949 | Holmsten | 70/DIG. 57 X |
| 3,277,676 | 10/1966 | Poehlmann et al. | 70/58 |
| 3,518,853 | 7/1970 | Bolte | 70/58 |
| 3,590,608 | 7/1971 | Smyth | 280/814 X |
| 3,624,317 | 11/1971 | Buckingham et al. | 70/DIG. 57 X |
| 3,830,416 | 8/1974 | Smedley | 294/147 X |
| 3,838,585 | 10/1974 | Foote | 70/58 X |
| 3,902,340 | 9/1975 | Leyden | 70/57 |
| 3,928,990 | 12/1975 | Stenz | 70/58 |
| 3,966,219 | 6/1976 | Look | 70/58 |
| 4,031,720 | 6/1977 | Avaiusini | 70/58 |
| 4,111,453 | 9/1978 | Krob | 280/626 |
| 4,185,361 | 1/1980 | Stuart | 70/58 |
| 4,353,521 | 10/1982 | Webb | 70/DIG. 57 X |

FOREIGN PATENT DOCUMENTS

| | | |
|---|---|---|
| 355962 | 8/1979 | Austria . |
| 2511455 | 9/1976 | Fed. Rep. of Germany . |
| 1512617 | 1/1968 | France . |
| 81/02679 | 10/1981 | World Int. Prop. O. . |

*Primary Examiner*—John J. Love
*Assistant Examiner*—Michael Mar
*Attorney, Agent, or Firm*—Flynn, Thiel, Boutell & Tanis

[57] ABSTRACT

An anti-theft lock for securing a binding to a ski, in particular a binding suited for the holding of ski shoes of any desired length without longitudinal adjustment. The binding includes structure which can be locked either in its stepping-in position or in its closed position by a lock, a switch or the like to thereby prevent removal of the binding from the ski.

12 Claims, 10 Drawing Figures

ANTI-THEFT LOCK FOR SKIS

FIELD OF THE INVENTION

The invention relates to an anti-theft lock for skis having a binding, in particular a binding which is suited for holding ski shoes of any desired length to a ski without any length adjustment.

BACKGROUND OF THE INVENTION

Anti-theft locks in many different forms have already been suggested for skis. One type of an anti-theft lock is formed by placing the two skis on top of one another by means of special fittings and to lock same in this position through a lock (see Pat. No. WO81/02679, U.S. Pat. Nos. 3,966,219 and 3,928,990 and French Pat. No. 1 512 617). The disadvantage of this type lies in the fittings not only being expensive to purchase, but being hindering at times also during skiing. Furthermore, snow easily settles in the fittings, which snow jeopardizes the function of the built-in lock.

In a similar known embodiment (see U.S. Pat. No. 3,277,676), one fitting each is secured on the two skis, which fittings are connected directly or through a coupling piece and can be secured through a padlock. Since the fittings are manufactured of a relatively thin sheet metal, the possibility of a damage during skiing does exist which, however, makes a moving in of the coupling piece or a direct engagement of the padlock impossible.

According to U.S. Pat. Nos. 3,590,608 and 4,185,361 a steel rope or cable is utilized for securing the skis against theft, which steel rope or cable is secured by means of a loop on a fence, a tree or the like and is then placed around the two skis. The rope ends are connected with one another by a cylinder lock or by a padlock.

A modification for this suggestion is described in U.S. Pat. Nos. 3,518,853 and 3,838,585. In this construction, the two skis and the ski poles are held by means of a steel rope, which carries a number lock—such steel ropes are generally common for locking of bicycles—on a storage rack for skis.

U.S. Pat. No. 3,830,416 in turn describes a carrying mechanism for skis, which at one end has an approximately U-shaped bar into which the ends of the skis are placed and which through a cross part can be locked with a cylinder lock, so that a removing of the skis is impossible.

The anti-theft lock according to U.S. Pat. No. 4,031,720 serves to connect a pair of skis with one another, which are placed on both sides of a horizontal storage rail, by cylinder locks which are provided in the front and the rear area of the skis, thus on both sides of the rail. Each ski has for this purpose two throughgoing bores for receiving locking elements. These bores extend to the running surface and can therefore easily ice up.

Finally German OS No. 25 11 445 illustrates a solution in which, for the anti-theft lock, the braking blades of a ski brake are utilized. The braking blades are moved into the braking position by means of a plastic part which is adjustable in longitudinal direction of the ski, in which braking position the two braking blades at least partly extend below the running surface of the ski. This position is thereafter secured through a special key. Only the owner of the ski is capable of releasing the plastic part by means of the key and to move it thereafter into the position which permits an upward swinging of the two braking blades. A use of this anti-theft lock is therefore possible only in the case of skis with such braking blades, thus does not have universal applications.

The goal of the invention is to overcome the disadvantages of the known designs and to provide an anti-theft lock of the abovementioned type, which can be used universally, is simple in its design, is inexpensive to manufacture, and which makes it impossible for a thief to use those skis equipped with the inventive anti-theft lock.

This goal is inventively achieved primarily by the binding either in its stepping-in position or in its closed position being lockable by a lock, a switch or the like.

Furthermore, the invention provides that in the locked position of the binding through a movable, swingable or shiftable part, preferably on the binding, at least one of the fastening members, for example fastening screws, with which the binding is secured on the ski, is mostly covered. Through this cover, the advantage is achieved that a use of stolen skis is not possible not even if a thief should try to replace the locked binding with another one. Also this inventive measure is independent of the type of the fastening of the binding on the ski, since both bindings which are screwed on the ski and also binding parts which are guided on rails and are secured through a stop screw, are protected through this measure.

The following inventive characteristics aim also in this direction, namely that for the fastening screws, which secure the base plate of the binding to the ski, threaded bushings are built into the ski below the upper strip, which bushings are supported on the underside of the upper strip, and that the threaded bushings are connected with one another through webs or through a plate. The binding can be removed from the ski only with force through these characteristics, whereby the ski is simultaneously destroyed.

In order to simplify the manufacture of skis with threaded bushings, it is furthermore provided that the threaded bushings are designed in one piece with the upper strip. If the upper strip is formed by a metal plate, for example an aluminum plate, then the threaded bushings are simply cast at the same time during the manufacture of the plate. If, however, the upper strip is manufactured of a fiber-reinforced laminate, then the threaded bushings are pressed at the same time during the manufacture of the laminate.

A further development of the invention, which is designated for bindings having a sole plate relative to which a slide plate is movably guided, is distinguished by at least one of its fastening members through the slide plate being inaccessible for a release in the locked position of the binding. If for example each fastening member is constructed as a normal slot bolt, then in the case of at least one of the screws, the slot must be covered by the slide plate in the locked position of the binding.

It has proven to be preferable in the case of this design if, according to a different development of the invention, the slide plate is provided with holes which, either in the stepping-in position or in the closed position of the binding, are in alignment with the fastening members, for example with the screws, and if the slide plate in the respective other position, in which its holes are offset with respect to the screws and the like of the ski, is locked through the lock, the switch or the like against movement. This characteristic makes it possible for all fastening members, for example screws, to be locked in the locked position of the binding against a release.

Various possibilities are offered for the construction of the lock itself. Thus the lock can be constructed inventively as a cylinder mortise-like dead lock. This solution has the advantage that the lock during skiing is not provided on the ski, thus can neither ice up nor become dirty. Of course, the skier must carry with him the lock for each ski during skiing.

This disadvantage does not occur, if according to another inventive suggestion, the lock is a cylinder lock, the housing of which is anchored in a bore in the binding or in the ski, and the cylinder of which is axially movable in the housing. If the binding is to be locked, the cylinder engages a bore of a movable part of the binding and is locked in this position. This mechanism is not limited to cylinder locks, but can also be applied to number locks.

A further inventive solution is distinguished by the lock being a cylinder lock, the housing of which is anchored in a bore in the binding or in the ski and the cylinder of which at its end which projects beyond the housing has two lateral flattened areas. Of course, the end of the cylinder which projects from the housing engages a keyhole-like slot in a binding element, in which it can move during skiing, whereas in the locked position of the binding the two lateral flattened areas extend perpendicularly with respect to the longitudinal extent of the slot and in this manner stop a movement.

Moreover, the inventive anti-theft lock must not necessarily have a lock in the more narrow sense, but it can also be equipped with elements which carry out the function of a lock. For example, it is possible to rotatably support a conventional bolt in the sole plate of the binding in a cross bore which is arranged parallel with respect to the plane of the plate, the center area of which bolt has two parallel laterally flattened areas and engages in a keyhole-like, through-going bore of a binding part which is guided in longitudinal direction of the ski, whereby the bolt can be turned at 90° by means of a special key. Such a bolt is described in the already discussed German OS No. 25 11 445, however, for a different purpose, namely for locking two braking blades and not the ski binding.

Finally the invention provides, that the bolt is held in each end position by a locking member which is biassed by a spring. In this manner each end position of the bolt is clearly defined even when the bolt, due to a longer use of the ski binding, should be slightly worn in its bearings and should no longer be sufficiently held through the friction in the two bearings.

Further characteristics and details of the invention will be discussed in the following description.

BRIEF DESCRIPTION OF THE DRAWINGS

Exemplary embodiments of the subject matter of the invention are illustrated in the drawings, in which:

FIGS. 5 and 6 illustrate a second embodiment of an anti-theft lock, wherein FIG. 5 is a longitudinal cross-sectional view of a binding which is locked in the skiing position and FIG. 6 is an enlarged cross-sectional view taken along the line VI—VI of FIG. 5, whereby, however, the anti-theft lock is released and permits a voluntary or automatic opening of the heel holder;

FIGS. 9*a* and 9*b* are both a cross sectional view taken along the line IX—IX in FIG. 8, wherein FIG. 9*a* shows the lock in its uppermost position and FIG. 9*b* shows the lock in its lowermost position for skiing.

DETAILED DESCRIPTION

Figure 1:
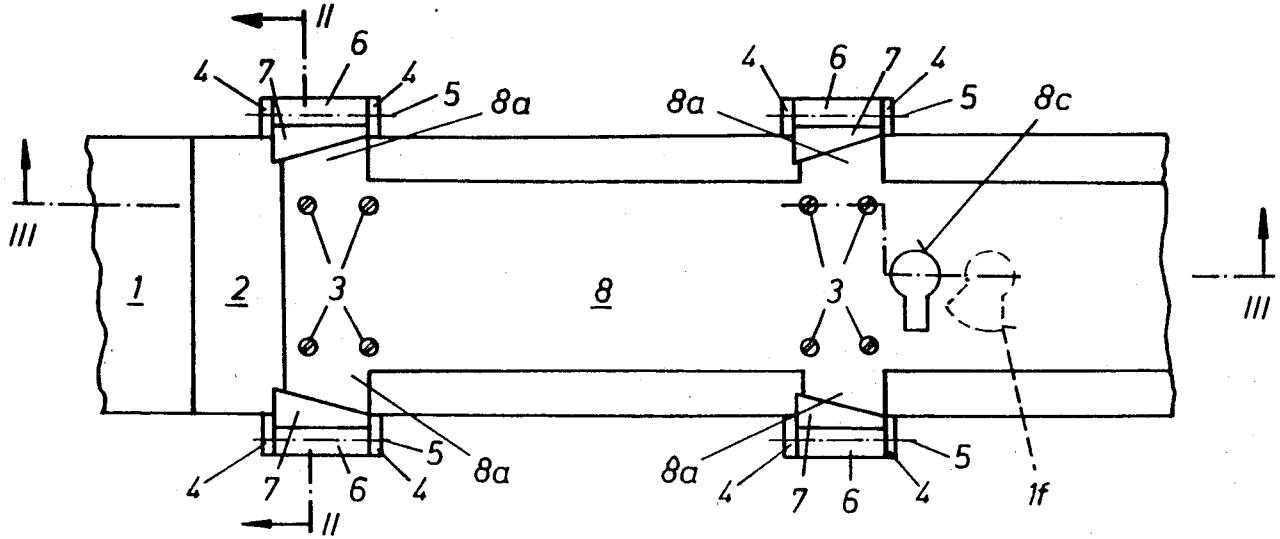
FIG. 1 is a top view of a ski, which is equipped with a first embodiment of an anti-theft lock according to the invention, the sole plate of the binding being removed therefrom.
Figure 2:
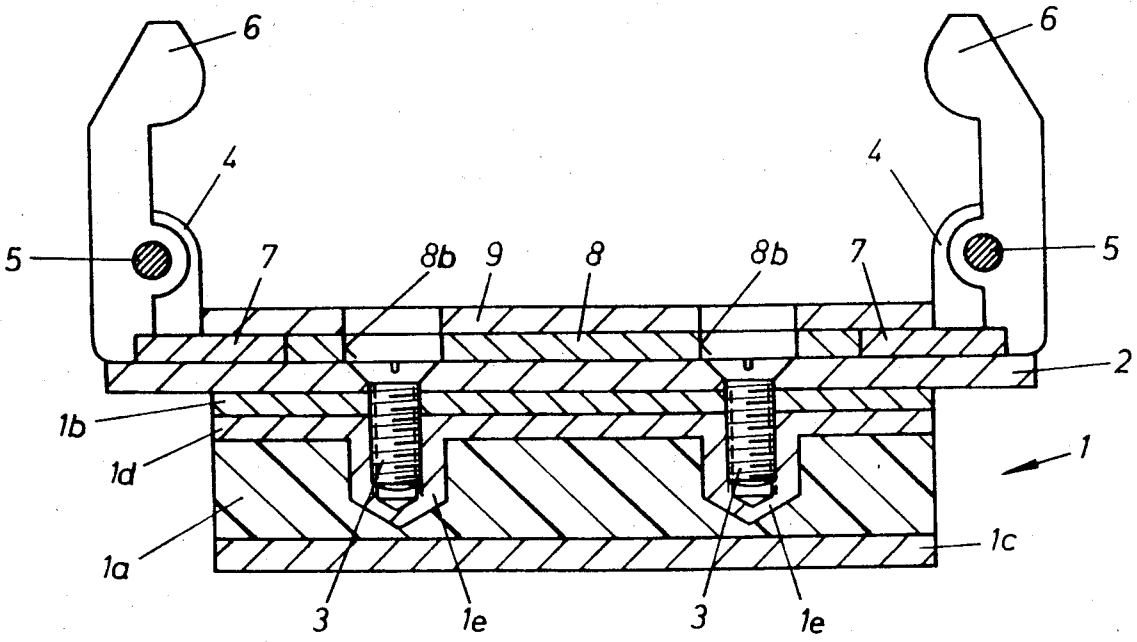
FIG. 2 is an enlarged cross-sectional view taken along the line II—II of FIG. 1.

In FIGS. 1 to 4, reference numeral 1 identifies a ski in its entirety. It consists, as can be seen from FIG. 2, of a core 1*a*, an upper strip 1*b* and a lower strip 1*c*. An intermediate plate 1*d* is arranged between the core 1*a* and the upper strip 1*b*, which plate is constructed in one piece with plural internally threaded sockets 1*e* formed thereon.

The base plate 2 of the ski binding is secured on the ski 1 by means of screws 3. The base plate 2 projects laterally beyond the edge of the ski 1 and carries plural bearing blocks 4 on the portions thereof that project beyond the lateral edges of the ski. The bearing blocks are arranged in pairs along both lateral edges of the base plate 2. Between each set or pair of bearing blocks 4 there is provided a swivel axle 5 pivotally supporting a clamping jaw 6, which clamping jaw is constructed as a two-arm lever. Slide members 7 are guided by means of not illustrated guideways transversely with respect to the longitudinal axis of the ski on the base plate 2. The back or laterally inwardly facing sides of the slide members 7 are arranged inclined with respect to the longitudinal axis of the ski and converge toward the tip of the ski. Each slide member 7 rests on its front or laterally outwardly facing side on the lower arm of the associated clamping jaw 6.

A slide plate 8 is furthermore movably guided in the longitudinal direction of the ski on the base plate 2. The plate 8 has plural shoulders 8*a* thereon which are each associated with the slide members 7. Of course, the inclination of the front or laterally outwardly facing narrow sides of the shoulders 8*a* corresponds with the inclination of the back sides of the slide members 7. The slide plate 8 has further holes 8*b* (FIG. 2) therein, which are in alignment with the sockets 1*e* and the screws 3 therein when in the clamping position of the ski binding. Furthermore, the slide plate 8 has a keyhole-like bore 8*c* formed therein, which, in the clamping position of the ski binding, is spaced at a distance from a corresponding blind hole 1*f* in the ski 1. The axes of the blind hole 1*f* and bore 8*c* are coaxial when the slide plate is in the locking position.

Figure 3:
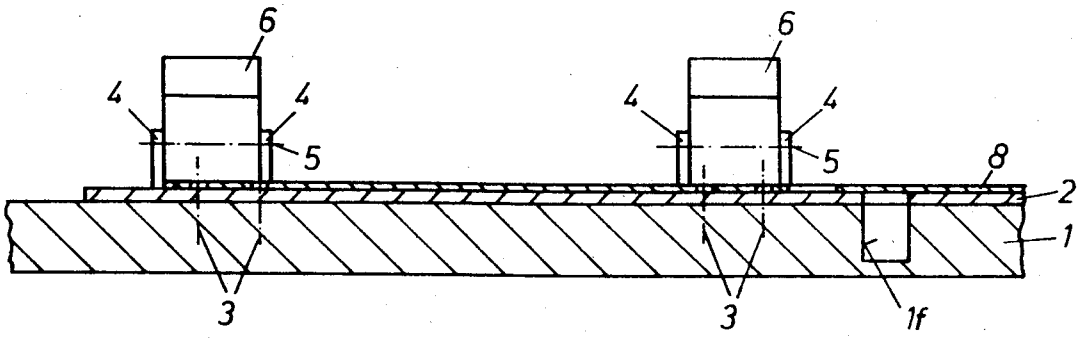
FIG. 3 is a cross-sectional view taken along the line III—III of FIG. 1 and of the ski binding in the clamped position.
Figure 4:
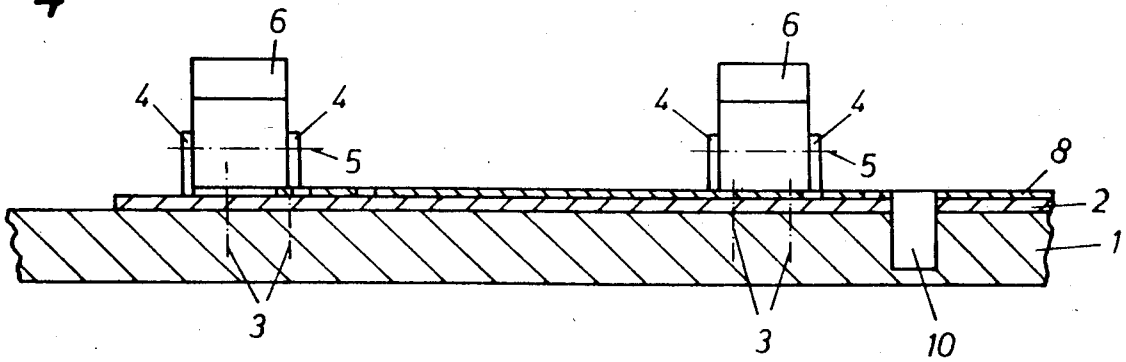
FIG. 4 is a cross-sectional view which corresponds with FIG. 3, in which, however, the function of the ski binding is blocked by an anti-theft lock.

The ski shoe itself is not illustrated in FIGS. 1 to 4. It is pressed during skiing by the clamping jaws 6 against a sole plate 9, which extends in the longitudinal direction of the ski and is arranged ski-fixed above the slide plate 8 or the slide members 7. The sole plate 9 has holes and a bore therein, which are in alignment with the screws 3 and the bore 1*f* in the ski 1. FIGS. 1, 3 and 4 purposefully have omitted therefrom the sole plate 9 for the reason of clarity in illustration.

The mechanism for moving the slide plate 8 into the clamping position is of a known type of construction and for this reason not illustrated. The same is true for the apparatus which, during an overload in a vertical plane (frontal fall) or during an overload in an inclined plane (so-called "diagonal fall") causes a movement of the slide plate 8 in FIG. 1 to the right and thus causing the clamping jaw 6 to release the ski shoe.

During a mounting of the ski binding, the slide plate 8 is shifted relative to the base plate 2 so that the holes 8*b* in the slide plate are in alignment with the holes in the base plate 2, which aligned holes serve to receive the screws 3. The binding can therefore be mounted without any difficulties. If the ski 1 is to be secured against theft, then the slide plate 8 is moved manually from its clamping position so that the bore 8*c* therein is aligned with the blind hole 1*f* in the ski. In this position, it is possible to move a conventional cylinder mortise-like dead lock 10 into the two aligned bores 1*f* and 8*c*. The lock 10 is schematically illustrated in FIG. 4.

Figure 5:
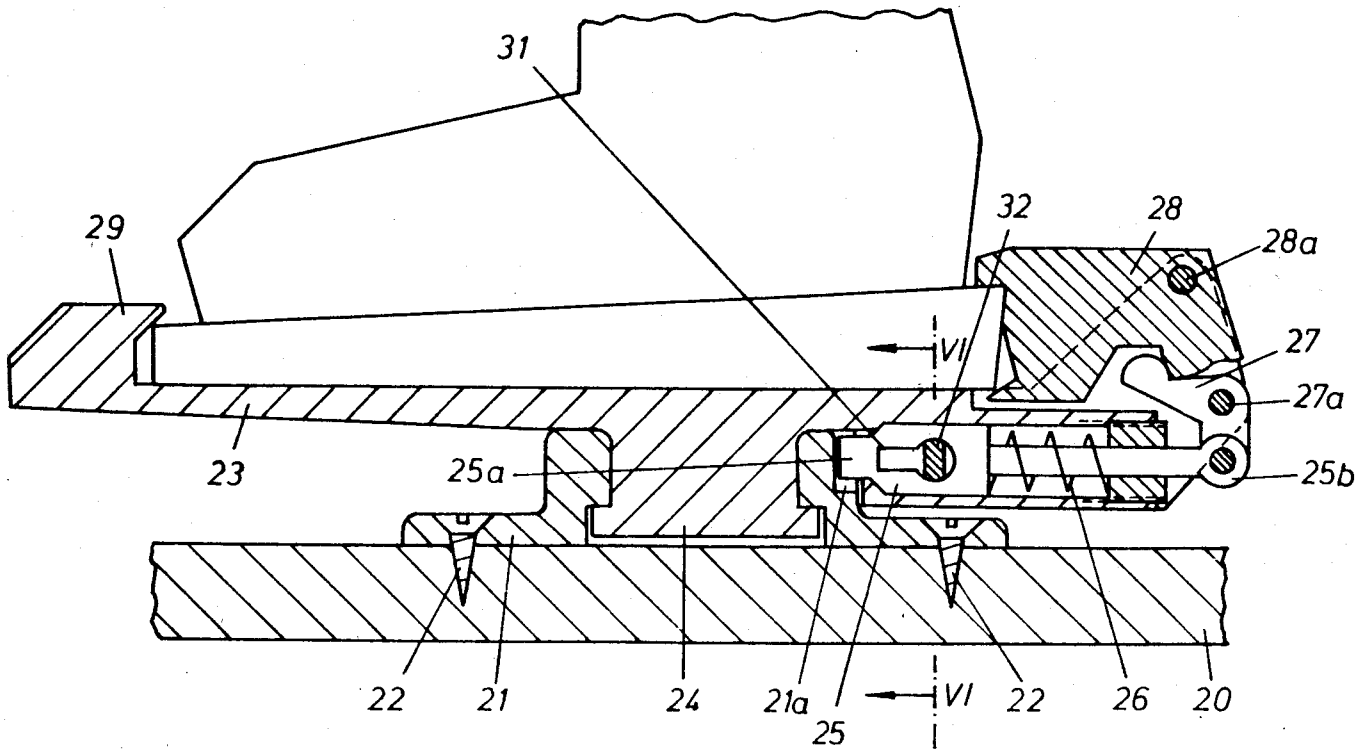
Figure 6:
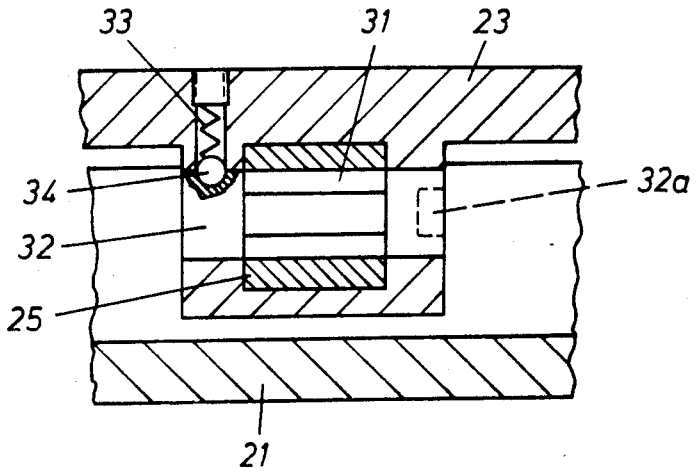

In the binding according to FIGS. 5 and 6, a base plate 21 is secured on a ski 20 by means of screws 22. A sole plate 23 having a shoulder thereon is rotatably supported and is secured in the base plate 21 against removal. The base plate 21 has a radially outwardly opening recess 21*a* therein, into which is received a piston 25 having a locking projection 25*a* thereon. The piston 25 is under the influence of a compression spring 26 which can be adjusted in its initial tension and which surrounds a piston rod 25*b*. A two arm lever 27 is pivotally supported on the sole plate 23 at the rear end thereof and for movement about a transversely extending axis 27*a*. One arm of the lever 27 is hinged to the piston rod 25*b* coupled to the piston 25 and the other arm thereof has a locking cam thereon which is received in a recess in a rear jaw member 28. The rear jaw member is also pivotally supported for movement about a transversely extending axis 28*a* on the sole plate 23. The compression spring 26 urges the rear jaw 28 for pivotal movement about the axis 28*a* into a clamping relation with the ski shoe. The front jaw 29, on the other hand, is secured rigidly or integrally formed on the sole plate 23.

During a frontal fall or during a voluntary release of the binding, the rear jaw 28 in FIG. 5 is swung clockwise about the transverse axis 28*a* and through this the binding is moved into the stepping-in position. At the forward end of the piston 25, as has already been discussed, there is provided the locking projection 25*a* which is received in the radially outwardly opening recess 21*a* on the outside of the base plate 21. In the case of a twisting fall, the piston 25 is moved back against the force of the compression spring 26, which at the same time permits an upward swinging of the rear jaw 28. By blocking the movement of the piston 25, it is therefore possible to make the binding nonfunctional and at the same time prevent access to the screws 22 by a screwdriver.

For this purpose, a keyhole-like recess 31 which extends in a transverse direction is provided in the piston 25, into which recess 31 is received a cylindrical bolt 32. The two ends to the bolt effect a rotatable support of the bolt in the sole plate 23. The central portion of the bolt has two oppositely lying laterally flattened areas. The bolt 32 also has at one end an irregularly formed recess 32*a* therein, into which can be inserted a separate key which is only designated for the owner of the ski 20. Of course, the bolt 32 is secured against an unintended rotation due to the provision of a locking ball 34 or the like, which is biassed by a compression spring 33, both in the position in which the laterally flattened areas extend parallel with respect to the upper side of the ski and permit a movement of the piston 25, and also in the position in which the flattened areas are positioned vertically on the upper side of the ski to block movement of the piston and as shown in FIGS. 5 and 6.

Figure 7:
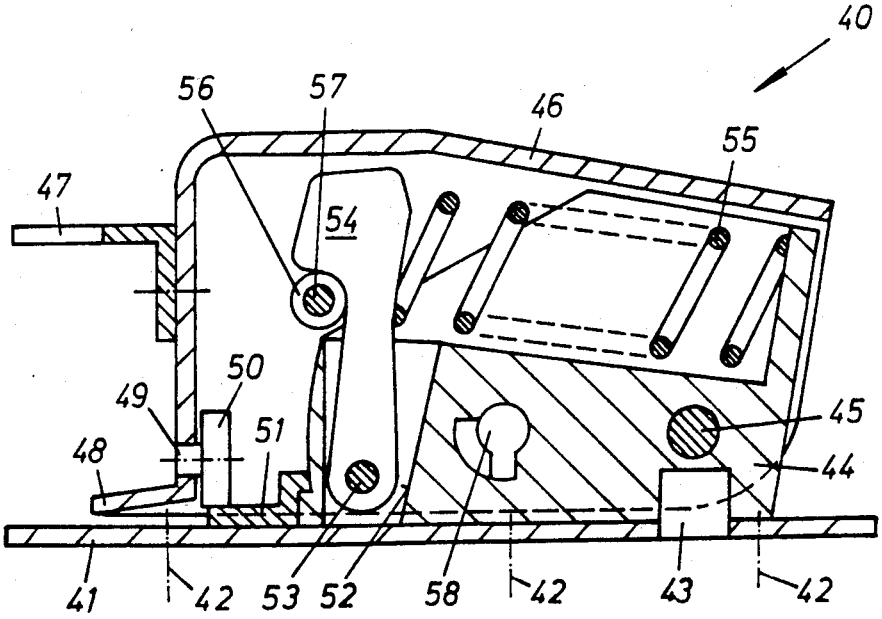
FIG. 7 is a longitudinal cross-sectional view of a heel down-holding means, which in its clamping position can be secured by means of an anti-theft lock.

A heel down-holding means is illustrated in the skiing position in FIG. 7, which means is identified in its entirety by the reference numeral 40. The heel down-holding means 40 includes a base plate 41 which is secured to a not illustrated ski by means of screws 42. The base plate 41 carries a vertically extending axle 43, about which can be pivoted a base member 44 in a plane which is parallel with respect to the upper side of the ski. The base member has a horizontal transversely extending axle 45 pivotally supporting a housing 46 which carries at its front end a sole holder 47 and a stepping spur 48. Near the stepping spur 48 there is arranged an axle 49 for a roller 50 oriented inside the housing 46. The roller 50 is adapted to move along a control cam 51 secured to the base plate 41.

The base member 44 has a through-going vertical recess 52 which enlarges upwardly and which has an axle 53 extending therethrough at the lower region of the recess. A locking member 54 is swingably supported on the axle 53. The locking member 54 is loaded by a compression spring 55, the other end of which is supported on the base member 44. Further, the spring tension can be adjusted by an adjusting screw in a conventional manner, not illustrated. The locking member 54 is pressed against a roller 56 by the compression spring 55. The roller is rotatably supported on a transversely extending axle 57, the ends of which are supported in the two sidewalls of the housing 46.

A transversely extending, keyhole-like recess 58 is provided in the base member 44, into which recess 58 can be inserted a not illustrated cylinder mortise-like dead lock so that it does not only extend through the base member 44, but also through two aligned holes in the sidewalls of the housing 46. This lock hinders on the one hand a pivoting of the housing 46 about the axis of the transverse axle 45 and, on the other hand, a rotation of the base member 44 about the axis 43. Since due to the roller 50 a pivoting of the base member 44 results simultaneously in a pivoting of the housing 46 about the axis of the transverse axle 45, such pivotal movement is not possible due to the inserted lock. Therefore, a use of the ski is impossible.

In addition to the foregoing, the inserted lock also prevents an unscrewing of the heel down-holding means 40 from the ski, since the heads of the screws 42, with which the heel down-holding means is screwed onto the ski, are covered in the locked position by the base member 44 or by the housing 46.

Figure 8:
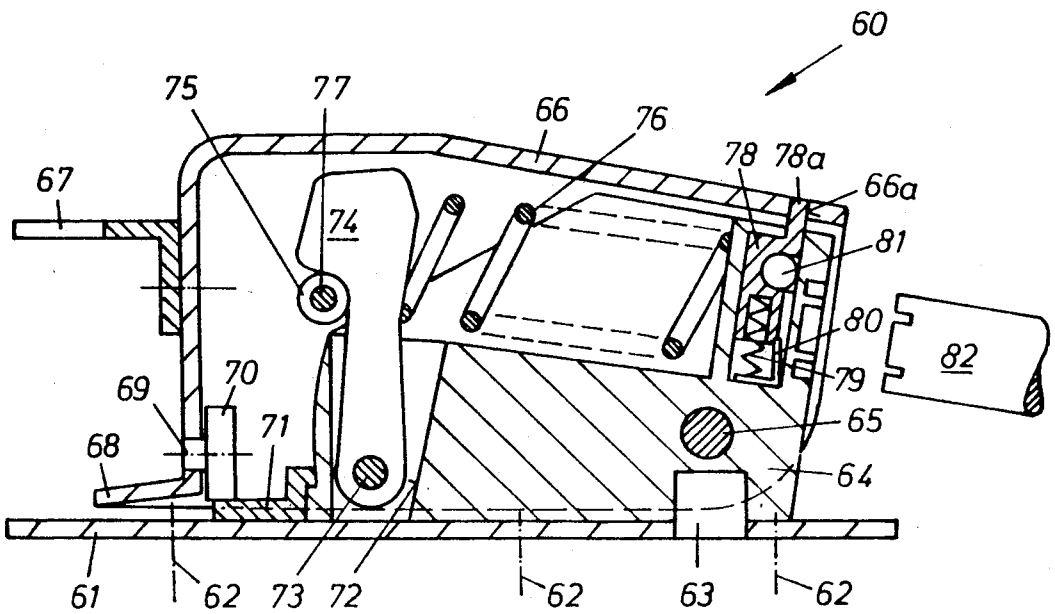
FIG. 8 is a longitudinal cross-sectional view of a heel down-holding means, which, however, in contrast to the heel down-holding means according to FIG. 7 can be locked in the clamping position by means of a conventional magnet-operable lock.

The heel down-holding means according to FIG. 8, which in its entirety is identified by the reference numeral 60, has a base plate 61 which is secured by means of screws 62 on a not illustrated ski. A vertically extending axle 63 is arranged on the base plate 61, about which axle a base member 64 can be pivoted in a plane which is parallel with respect to the upper side of the ski. The base member 64 is made of a material which cannot be influenced magnetically, for example of plastic, and has a horizontal transversely extending axle 65 for a housing member 66. The housing member 66 carries at its front end which faces the ski shoe a sole holder 67 and a stepping spur 68. Near the stepping spur 68 in the housing 66 there is arranged an axle 69 for a roller 70 which is provided inside the housing. The roller 70 moves along a control cam 71 secured to the base plate 61.

The base member 64 has a through-going vertical recess 72 which enlarges upwardly and which has a transversely extending axle 73 extending therethrough, which axle 73 is provided at the lower region of the recess. A locking member 74 is supported swingably on the axle 73. The locking member 74 is biassed by a compression spring 76. The other end of the compression spring 76 is supported on the base member 64. The spring 76 can be adjusted in its initial tension in a conventional manner by an adjusting screw or the like, not illustrated. The locking member 74 is urged against a roller 75 by the spring 76, the transversely extending axle 77 of the roller being supported in the two sidewalls of the housing 66.

In order to secure the housing 66, through a magnetically operable lock, against a swinging and with this the heel holder 60 against a use, a latch 78 is movably guided in an upwardly open recess, the axis of which extends substantially perpendicularly with respect to the plane of the base plate, in a wall which is arranged on the side of the base member 64, which side is remote from the ski shoe. The latch includes a latch head 78*a* receivable into, in the locking position of the heel down-holding means 60, a recess 66*a* in the housing 66. The latch 78 is under the influence of a compression spring 79, which over a portion of its length is stored in a blind hole of the latch. The other end of the spring 79 rests on one arm of a two arm lever 80, the other arm of which, in the locking position of the lock, is received in a recess of the latch 78. The two arm lever 80 is manufactured of a magnetically conducting material. The two arms define an angle of approximately 80°. Furthermore, the latch 78 has a recess in which is stored a roller 81 of a magnetically conducting material.

A key 82 is associated with the magnetically operable lock, which key 82 is constructed as a permanent magnet. The key 82 has on its front face a pattern in the form of projections and recessess, which during opening of the lock can be inserted into corresponding recesses in the back side of the base member 64.

Figure 9A:
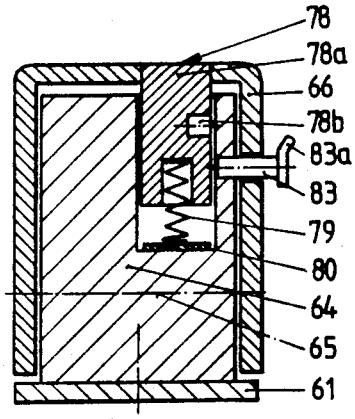
Figure 9B:
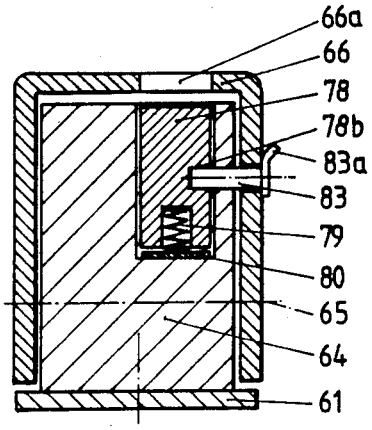

If the lock is to be opened, then the key 82 is brought into contact with the back side of the base member 64, whereby the projections of the key engage corresponding recesses in the back side. Two operations are released through the key 82: First, the bent lever 80 is swung clockwise against the urging of the spring 79 through about 10°, whereby it releases the latch 78. Second, the latch 78 is thereafter pulled downwardly by the key 82, which acts onto the roller 81. Of course, the path of movement of the latch 78 is dimensioned such that the latch head 78*a* leaves the recess 66*a* in the housing 66 and the latter can pivot unhindered. In the skiing position, the latch 78 of the heel down-holding means 60 is held in its lowermost position by a locking bar 83. Details of the locking bar and of its working mechanism is shown in FIGS. 9*a* and 9*b*. Since the spring 79 is arranged on the bent lever 80, which is supported by the base member 64, and the spring 79 biases with its other end the latch 78, it is selfexplanatory that the latch 78 stays in its uppermost position. The skiing position is shown in FIG. 9*b* in which the locking bar 83 is received in an opening 78*b* of the latch 78. The locking bar 83 has for an easier opening movement an extension 83*a*.

Should in place of a mechanical heel down-holding means an electric binding be used, then the permanent magnet in the key 82 can be replaced with an electromagnet.

Of course, the invention is by no means to be limited to the exemplary embodiments which are illustrated in the drawings and which are described above. Rather various modifications of the same are possible without departing from the scope of the invention. For example, the lock can be a cylinder lock, the housing of which is anchored in a bore of the one part and the cylinder of which, which is axially movable in the housing, engages in locked position a bore of another movable part of the binding. Such cylinder locks are actually known and are utilized, for example, in the furniture building industry for the locking of boxes with sliding doors. Furthermore, it would also be possible to utilize a number lock in an analogue manner.

Furthermore, the bolt 32 which is illustrated in FIGS. 5 and 6 can be replaced with a cylinder lock, the housing of which is anchored in the sole plate and the cylinder of which has at the projecting end, which projects into the recess of the piston, two laterally flattened areas. The flattened areas on the cylinder, during the use of the ski binding by the owner, are received into the slot which extends in the longitudinal direction of the ski.

The embodiments of the invention in which an exclusive property or privilege is claimed are defined as follows:

1. An anti-theft lock for a ski having a ski binding means mounted thereon, said ski binding means having a base plate means adapted to be affixed to a ski, and a ski boot holding means movable between a ski boot releasing position and a ski boot holding position in response to an operation of a safety release mechanism, said anti-theft lock comprising:

means defining plural holes in said base plate means adapted to receive in each thereof a fastening element, at least one of said holes being inaccessible only when said ski boot holding means is in one of said ski boot holding and releasing positions, all of said holes being accessible only when said ski boot holding means is in the other of said ski boot holding and releasing positions; and cooperative locking means on one of said ski and said base plate means, and said ski boot holding means separate from said safety release mechanism for releasably locking the position of said ski boot holding means in one of said ski boot holding and releasing positions to thereby render at least one of said holes and, consequently one of said fastening elements inaccessible for preventing removal of said ski binding from said ski by anyone without a means to operate said locking means.

2. The anti-theft lock according to claim 1, wherein said fastening elements are screws which secure said base plate means of said ski binding means to said ski; and wherein an upper strip plate is provided on said ski intermediate said ski and said base plate means, said upper strip plate having oriented thereon plural internally threaded holes.

3. The anti-theft lock according to claim 2, wherein said internally threaded holes are formed in one piece with said upper strip plate on said ski.

4. The anti-theft lock according to claim 1, wherein said ski boot holding means includes means defining a sole plate and a slide plate, said slide plate being movably guided on said base plate means corresponding to said ski boot holding position and ski boot releasing position; and wherein, in said at least one of said ski boot holding position and said ski boot releasing position of said ski boot holding means, at least one of said fastening elements is rendered inaccessible by said slide plate.

5. The anti-theft lock according to claim 4, wherein said slide plate is provided with plural holes, which either in said ski boot holding position or in said ski boot releasing position of said ski boot holding means, are in alignment with all of said fastening elements, and wherein said slide plate, in the respectively other position, has its holes offset relative to said fastening elements.

6. The anti-theft lock according to claim 1, wherein said locking means is contructed as a cylinder mortise-like dead lock.

7. The anti-theft lock according to claim 1, wherein said locking means is a cylinder lock having a housing into which is lockably received a cylinder, said housing being anchored in a bore in at least one of said base plate means and said ski and said cylinder being axially movable in said housing into and out of a hole in said ski boot holding means, said hole being movable into and out of alignment with said bore.

8. The anti-theft lock according to claim 7, wherein said cylinder has an end which projects beyond said housing, said end having two lateral flattened areas.

9. The anti-theft lock according to claim 1, wherein said locking means is a number lock having a housing into which is lockably received a closing member, said housing being anchored in a bore in at least one of said base plate means and said ski and said closing member being axially movable in said housing into and out of a hole in said ski boot holding means, said hole being movable into and out of alignment with said bore.

10. The anti-theft lock according to claim 1, wherein said ski boot holding means includes a sole plate, wherein said locking means includes a bolt supported rotatably in said sole plate in a transverse bore arranged parallel with respect to a plane of an upper surface on said sole plate, the center area of said bolt having two parallel, laterally flattened areas receivable in a keyhole-like, through-going bore on said ski boot holding means, said keyhole-like bore having a stem part with longitudinally extending and spaced, parallel sidewalls, said ski boot holding means being guided for movement in a longitudinal direction of said ski, whereby said bolt and said laterally flattened areas thereon is rotatable 90° by means of a key into and out of alignment with a space between said sidewalls.

11. The anti-theft lock according to claim 10, wherein said bolt is held in each end position by a locking member which is biassed by a spring.

12. The anti-theft lock according to claim 1, wherein said locking means is a magnetically operable lock having a latch, said lock being provided on one of said base plate means and said ski, said latch having a latch head which, in at least one of said ski boot holding position and said ski boot releasing position of said ski binding means, is received in a recess of a movable part of said ski binding means, namely, said ski boot holding means.

* * * * *